US007744414B2

(12) United States Patent
Scherer et al.

(10) Patent No.: US 7,744,414 B2
(45) Date of Patent: Jun. 29, 2010

(54) CARRIER ASSEMBLY AND SYSTEM CONFIGURED TO COMMONLY GROUND A HEADER

(75) Inventors: Richard J. Scherer, Austin, TX (US); Joseph N. Castiglione, Cedar Park, TX (US); Abhay R. Joshi, Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 12/169,283

(22) Filed: Jul. 8, 2008

(65) Prior Publication Data

US 2010/0009571 A1 Jan. 14, 2010

(51) Int. Cl.
*H01R 13/648* (2006.01)

(52) U.S. Cl. ..... 439/607.05; 439/108; 439/607.08; 439/607.1

(58) Field of Classification Search ..... 439/108, 439/607.05, 607.08, 607.1, 701, 607.11
See application file for complete search history.

(56) References Cited

U.S. PATENT DOCUMENTS 3,587,028 A * 6/1971 Uberbacher ..... 439/49
5,114,355 A 5/1992 Kimmel et al.
5,184,965 A 2/1993 Myschik et al.
5,194,020 A 3/1993 Voltz
5,496,183 A 3/1996 Soes et al.
5,516,294 A 5/1996 Andrews et al.
5,904,594 A 5/1999 Longueville et al.
5,980,321 A 11/1999 Cohen et al.
5,993,259 A 11/1999 Stokoe et al.
6,146,202 A 11/2000 Ramey et al.
6,231,391 B1 5/2001 Ramey et al.
6,238,245 B1 5/2001 Stokoe et al.
6,299,483 B1 10/2001 Cohen et al.
6,358,062 B1 3/2002 Feldman et al.
6,368,120 B1 4/2002 Scherer et al.

(Continued)

FOREIGN PATENT DOCUMENTS

JP 2004274047 9/2004

OTHER PUBLICATIONS

Amphenoi TCS, VHDM Connector, http://amphenol-tcs.com/products/connectors/backplane/vhdm/index.html, printed on Feb. 25, 2008, 4 pages.

(Continued)

*Primary Examiner*—Tho D Ta
(74) *Attorney, Agent, or Firm*—Melanie G. Gover; Dean M. Harts

(57) ABSTRACT

An electrical connector system includes a header and a carrier assembly attachable with the header. The header includes a leading end having a plurality of signal pins that are insertable into an electronic device and a stripline ground plate extending from the leading end toward a mating end. The carrier assembly is coupleable with the mating end of the header and includes a plurality of termination devices. Each termination device includes a cable terminated to a contact that electrically couples with one of the signal pins of the header, an insulator disposed around the contact, and a tubular shield disposed around the insulator. When the carrier assembly is connected to the header, the tubular shield contacts the stripline ground plate to commonly ground each signal pin/contact connection within the electrical connector system.

11 Claims, 10 Drawing Sheets

U.S. PATENT DOCUMENTS

| | | | | |
|---|---|---|---|---|
| 6,371,813 | B2 | 4/2002 | Ramey et al. | |
| 6,379,188 | B1 | 4/2002 | Cohen et al. | |
| 6,503,103 | B1 | 1/2003 | Cohen et al. | |
| 6,506,076 | B2 | 1/2003 | Cohen et al. | |
| 6,520,802 | B1 | 2/2003 | Mitra | |
| 6,551,126 | B1 | 4/2003 | Feldman | |
| 6,554,647 | B1 | 4/2003 | Cohen et al. | |
| 6,607,402 | B2 | 8/2003 | Cohen et al. | |
| 6,712,646 | B2 | 3/2004 | Shindo | |
| 6,780,069 | B2 | 8/2004 | Scherer et al. | |
| 6,833,513 | B1 | 12/2004 | Ahmad | |
| 7,004,793 | B2 * | 2/2006 | Scherer et al. | 439/607.11 |
| 7,048,585 | B2 | 5/2006 | Milbrand, Jr. et al. | |
| 7,114,964 | B2 | 10/2006 | Winings et al. | |
| 7,553,187 | B2 * | 6/2009 | Feldman et al. | 439/108 |
| 2001/0005654 | A1 | 6/2001 | Cohen et al. | |
| 2002/0111068 | A1 | 8/2002 | Cohen et al. | |
| 2003/0052755 | A1 | 3/2003 | Barnes et al. | |
| 2007/0141871 | A1 | 6/2007 | Scherer et al. | |
| 2007/0197095 | A1 | 8/2007 | Feldman et al. | |

OTHER PUBLICATIONS

3M MetPak HSHM Backplane Connectors, Innovation HSHM Brochure, Copyright 3M 2002, 4 pages, 3M Electronic and Interconnect Solutions Division, Austin, TX.

* cited by examiner

CARRIER ASSEMBLY AND SYSTEM CONFIGURED TO COMMONLY GROUND A HEADER

BACKGROUND

Headers are modular electrical connectors that provide signal paths for signals, such as differential signals, between a main board (e.g., a mother board) and a secondary board (e.g., a daughter board) or other electrical components.

Headers are typically employed to electrically connect a large number of electrical signals between a series of daughter boards connected with a mother board in a manner that electrically interconnects different components in an electrical system. Other applications employ a header connected with a backplane or other connection board of an electronic system, where the header provides interconnection between the backplane and a carrier assembly attached to the header.

The connectors attached to a printed circuit board or a backplane connect with conducting traces on the board/backplane, and the conducting traces connect to signal pins of the header to route the signals between conductors in the board/backplane (or electronic components) to the electronic system.

Electronic systems have evolved to process more data and pack an increased number of circuits into the same area (or an even smaller area). Consequently, electrical connectors are challenged with carrying an increased number of electrical signals, each potentially having increased signal frequency. However, as signal frequencies increase, there is the possibility that electrical noise generated by signal connections, crosstalk, or electromagnetic interference could undesirably increase within the interconnection.

It is desirable to provide carrier assemblies that attach to headers in a manner that minimizes crosstalk between signal paths and provides controlled electrical impedance for each signal path. It is further desirable to provide electrical interconnectors and interconnection assemblies having high circuit switching speeds, increased signal line densities with controlled electrical characteristics, and improved/controlled signal integrity suited to meet the evolving demands of end-users.

SUMMARY

One aspect provides an electrical connector system including a header and a carrier assembly attachable with the header. The header includes a leading end having a plurality of signal pins that are insertable into an electronic device and a stripline ground plate extending from the leading end toward a mating end. The carrier assembly is coupleable with the mating end of the header and includes a plurality of termination devices. Each termination device includes a cable terminated to a contact that electrically couples with one of the signal pins of the header, an insulator disposed around the contact, and a tubular shield disposed around the insulator. When the carrier assembly is connected to the header, the tubular shield contacts the stripline ground plate to commonly ground each termination device within the electrical connector system.

Another aspect provides an electrical connector system including a header and a carrier assembly attachable with the header. The header includes a leading end having a plurality of differential signal pins that are insertable into an electronic device and at least two separated stripline ground plates extending from the leading end toward a mating end of the header. The carrier assembly is coupleable with the mating end of the header and includes an organizer and a plurality of termination devices. The organizer has a plurality of column organizer plates and row organizer plates that interlock to define an array of channels. Each termination device is at least partially disposed within one of the channels and includes a contact that electrically couples with one of the differential signal pins, an insulator disposed around the contact, and a tubular shield disposed around the insulator. The organizer abuts the stripline ground plate to electromagnetically shield connections within the electrical connector system.

Another aspect provides a carrier assembly configured to mate with a header having signal pins and a stripline grounding plate separating adjacent rows of signal pins. The carrier assembly includes an organizer organizing a plurality of termination devices. The organizer includes a plurality of column organizer plates and row organizer plates that interlock to define an array of channels. Each termination device is disposed at least partially within one of the channels and includes a cable terminated to a contact that electrically couples with one of the signal pins, an insulator disposed around the contact, and a tubular shield disposed around the insulator. The organizer aligns the termination devices for mating with the signal pins and the tubular shields are configured to form a common ground matrix around the signal pins.

Another aspect provides a method of commonly grounding stripline grounding plates in an electrical header. The method includes connecting a first termination device to a first signal pin of the header, and grounding a tubular shield of the first termination device to a first stripline ground plate of the header. The method additionally includes connecting a second termination device to a second signal pin of the header, and grounding a tubular shield of the second termination device to a second stripline ground plate of the header. The first and second stripline ground plates are commonly grounded by the tubular shield of at least one of the first and second termination devices.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that the features of the various exemplary embodiments described herein may be combined with each other, unless explicitly noted otherwise.

Embodiments provide a high speed carrier assembly that couples with a stripline header to commonly ground all ground plates within the stripline header. One embodiment of the carrier assembly is configured to commonly ground each connector within the electrical connector system. The carrier assembly includes multiple termination devices, where each termination device includes a cable terminated to a contact that is configured to electrically couple with a signal pin provided by the header. Each termination device includes a tubular shield that is configured to contact at least one of the ground plates within the header, such that the termination devices inserted into the header commonly ground one or more ground plates. In one embodiment, the tubular shields of the carrier assembly are configured to commonly ground all of the grounding plates in the header.

Some embodiments of the carrier assembly include coaxial termination devices. Inserting the coaxial termination devices into a header having differential signal pins converts and provides the header with fully insulated coaxial signals. Other embodiments of the carrier assembly include twinaxial termination devices having two contacts that connect with signal pins of the header. Other embodiments provide a header mated with a "universal" carrier assembly to provide differential fully shielded connections having common grounding.

Other embodiments provide a carrier assembly including an organizer configured to organize a plurality of termination devices, where the organizer abuts grounding plates in the connected header to electromagnetically shield the carrier assembly/header from interference.

Figure 1:
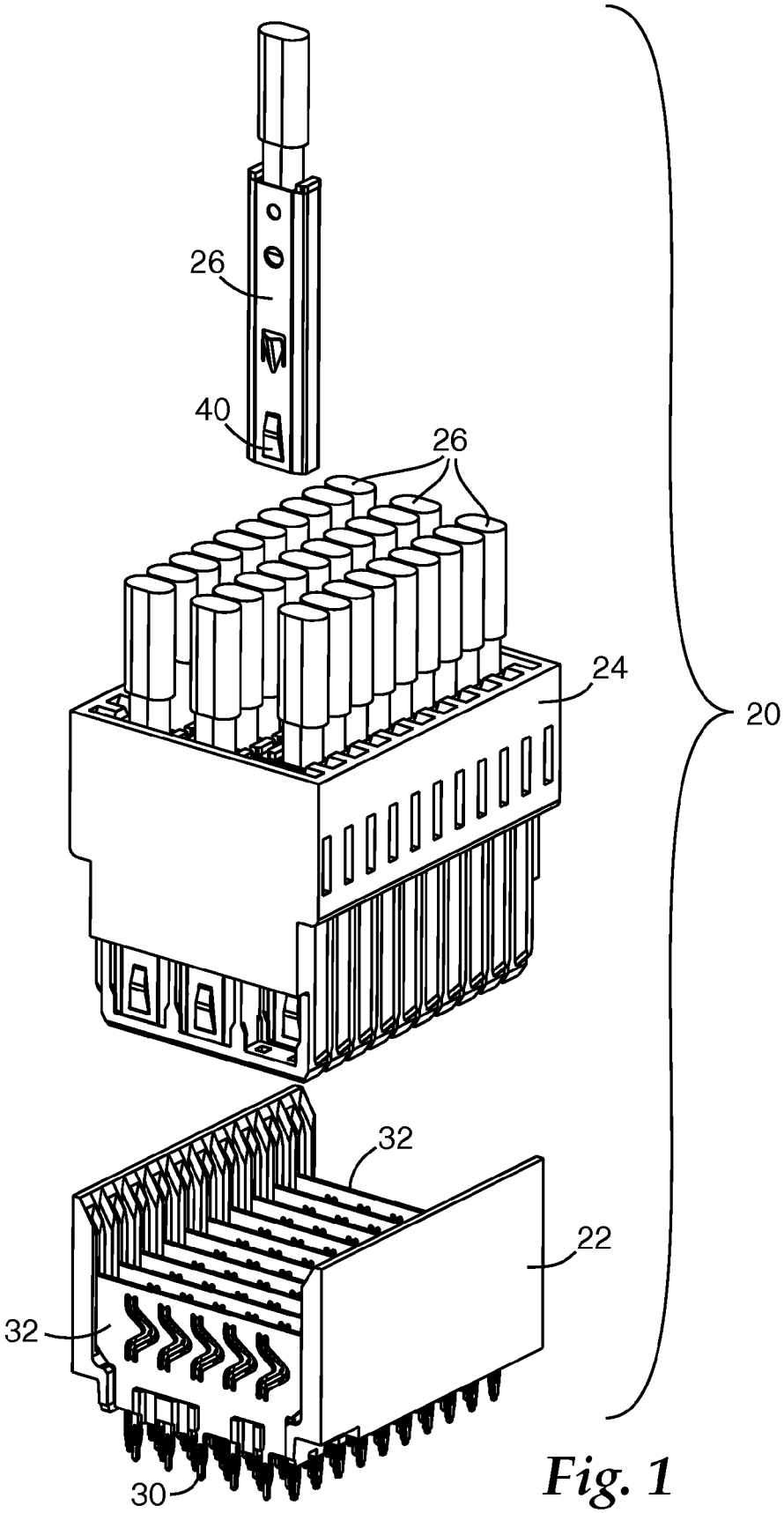
FIG. 1 is an exploded perspective view of an electrical connector system including a carrier assembly configured to couple with a header according to one embodiment.

FIG. 1 is an exploded perspective view of an electrical connector system 20 according to one embodiment. System 20 includes a header 22, a carrier assembly 24 configured to mate with header 22, and a plurality of termination devices 26 that are insertable into carrier assembly 24 to electrically connect with electrical pins provided by header 22.

In one embodiment, header 22 is configured to electrically connect with a backplane of an electronic system or provide interconnection to a printed circuit board or other device. Suitable headers 22 include COMPACT-PCI-compatible headers, connection modules having paired signal pins, or differential signal pin headers. In one embodiment, header 22 is a stripline header having signal pins 30 that are insertable into the backplane/board of a device and a plurality of ground plates 32 spaced along a length of header 22. In one embodiment, signal pins 30 are paired differential signal pins and ground plates 32 are stripline ground plates, although other pin and plate structures are also acceptable. In another embodiment, pins 30 include single-ended signal pins.

Carrier assembly 24 is configured to mate with header 22 such that an external contact 40 on termination device 26 forms a ground contact with ground plates 32. The termination devices 26 are organized within carrier assembly 24 and aligned for insertion into header 22 in a manner that commonly grounds each ground plate 32, which provides controlled electrical impedance for system 20 enabling system 20 to accommodate circuit switching speeds in the 3-5 GHz range.

Termination devices 26 are removable from the housing of carrier assembly 24 to enable termination devices 26 to be selectively removed and repaired. In this manner, carrier assembly 24 is easily "field-serviceable" by providing multiple removable and repairable termination devices 26.

Figure 2:
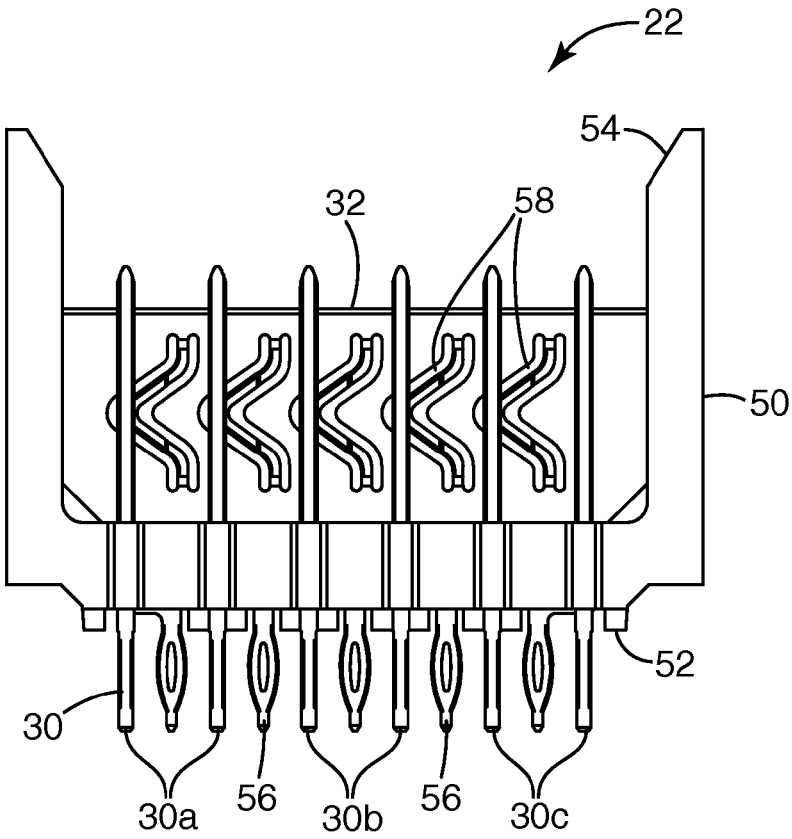
FIG. 2 is an end view of the header shown in FIG. 1.

FIG. 2 is an end view of header 22. Header 22 includes a housing 50 defining a leading end 52 and a mating end 54. Signal pins 30 project from leading end 52 for insertion into electronic devices, and mating end 54 receives carrier assembly 24 (FIG. 1). A separate set of compliant pins 56 extend into a core portion of header 22 and connect with grounding plates 32. In one embodiment, each grounding plate 32 includes stripline grounds 58 (or ground wipers 58) that are flexible and/or compliant and extend from a surface of ground plate 32. In another embodiment, the grounding plates are planar and are not provided with ground wipers, and external contact 40 on termination device 26 provides ground contact with ground plates 32.

In one embodiment, signal pins 30 are arranged in differential pairs 30*a*, 30*b*, and 30*c* of signal pins. Differential pairs 30*a*, 30*b*, 30*c* provide paired conducting paths, where the voltage difference between the conductive paths represents the signal through pins 30. In general, the two conducting paths of, e.g., differential pair 30*a* are arranged to run adjacent or near each other. In this manner, outside sources of electrical noise electromagnetically couples to the differential pair 30*a* resulting in a common noise voltage being coupled to both conducting paths in the differential pair 30*a*, which minimizes the undesirable interference affect on the signal through pin 30.

Figure 3A:
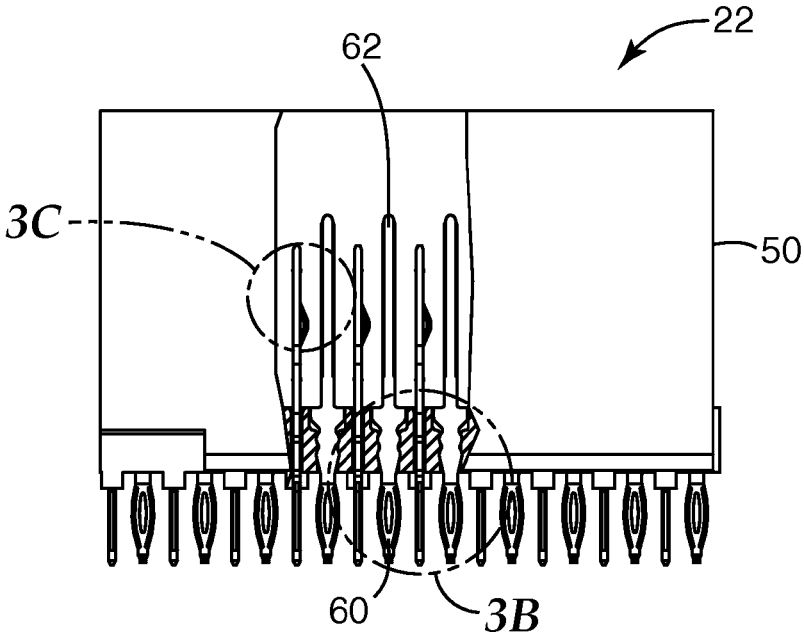
FIG. 3A is a side view of the header shown in FIG. 1.
Figure 3B:
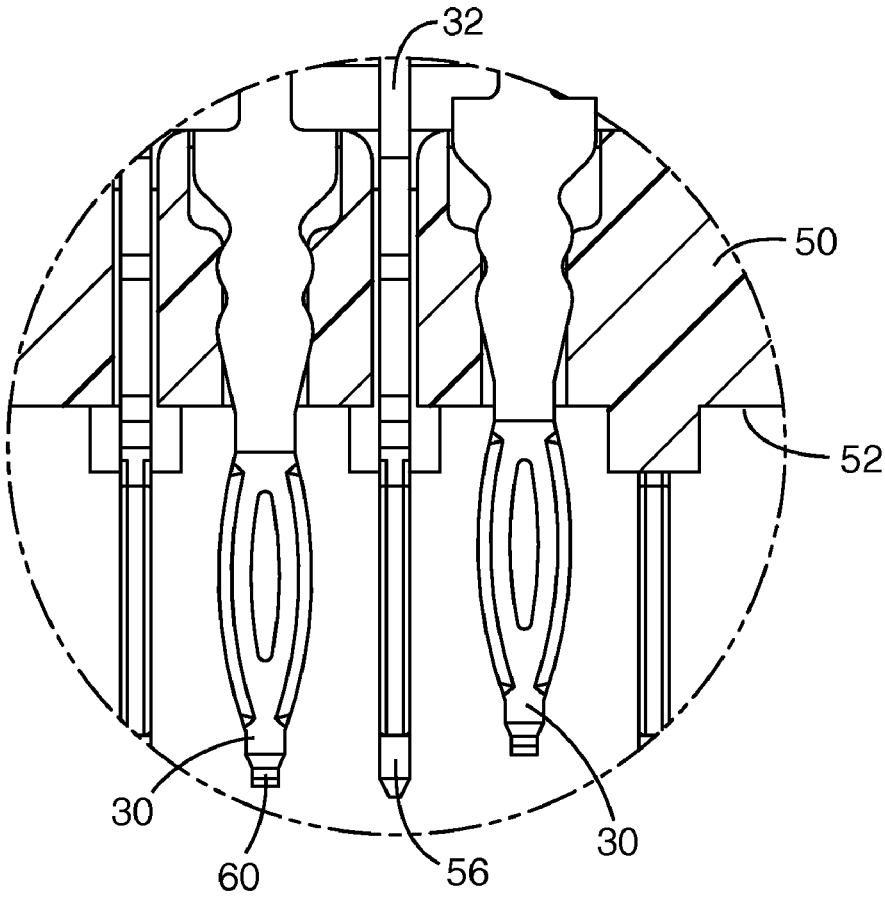
FIG. 3B is an enlarged view of signal pins and stripline ground plates of the header shown in FIG. 3A.
Figure 3C:
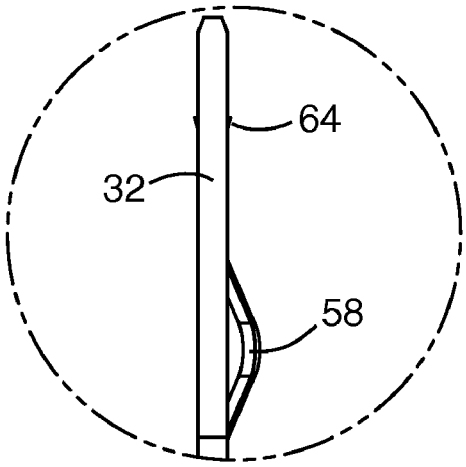
FIG. 3C is an enlarged view of a ground wiper of a stripline ground plate of the header shown in FIG. 3A.

FIG. 3A is a side view of header 22 oriented ninety degrees relative to the view shown in FIG. 2. FIG. 3B is an enlarged view of signal pins 30, ground pins 56, and stripline ground plates 32. Flat sides of signal pins 30 are shown in FIG. 3B in contrast to the thin sides of signal pins 30 shown in FIG. 2. FIG. 3C is an enlarged view of ground wiper 58 projecting from stripline ground plate 32.

Each compliant ground pin 56 is connected to one of the ground plates 32 and extends from leading end 52 of housing 50. That is to say, each ground plate 32 has one or more compliant pins 56 connected to plate 32. Consequently, each plate 32 is grounded, but all of plates 32 are not commonly grounded to other plates 32. In one embodiment, compliant ground pin 56 and ground plate 32 are integrally formed, although any suitable electrical connection between plate 32 and pin 56 is acceptable.

Referring to FIG. 3B, grounding plates 32 separate the rows of signal pins 30 and each row of 30*a* of differential signal pins. Thus, compliant ground pins 56 alternate between signal pins 30. Signal pins 30 include a first end 60 configured for insertion into electronic devices and a second end 62 that is configured to receive termination device 26 (FIG. 1).

Referring to FIG. 3C, stripline grounds 58 compliantly extend from a planar surface 64 of ground plate 32 by about 0.25 mm, although other dimensions for stripline ground 58 are also acceptable. Header 22 is conventionally configured such that stripline ground 58 provides a ground path for one of the plates 32 and a connector coupled to one of signal pins 30. Thus, as best shown in FIGS. 2 and 3A, ground plates 32 are not commonly grounded within header 22. In contrast, embodiments described below provide termination devices 26 that electrically couple with signal pins 30 and commonly ground each ground plate 32 within header 22.

Figure 4:
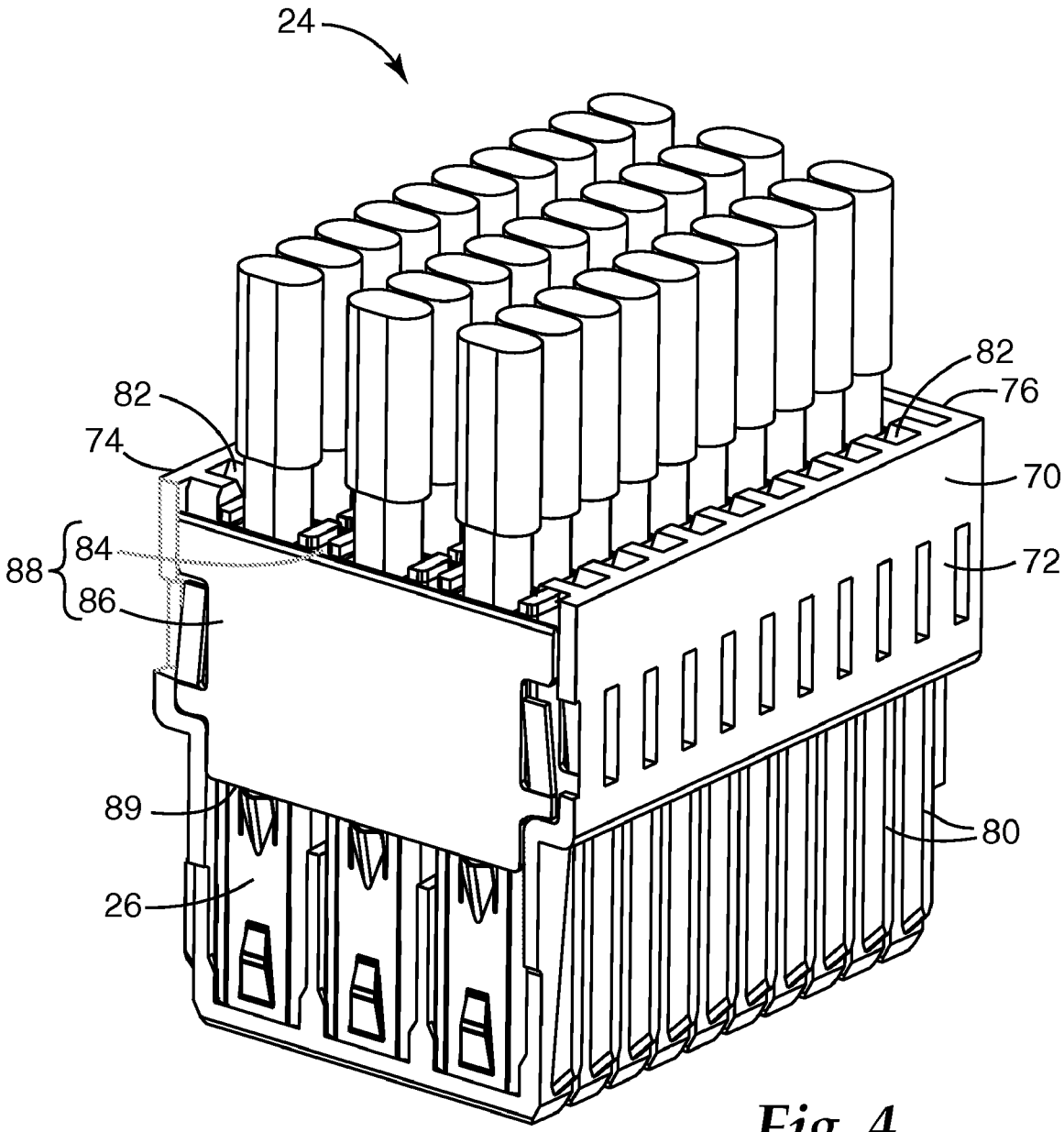
FIG. 4 is a perspective view of the carrier assembly shown in FIG. 1.
Figure 5:
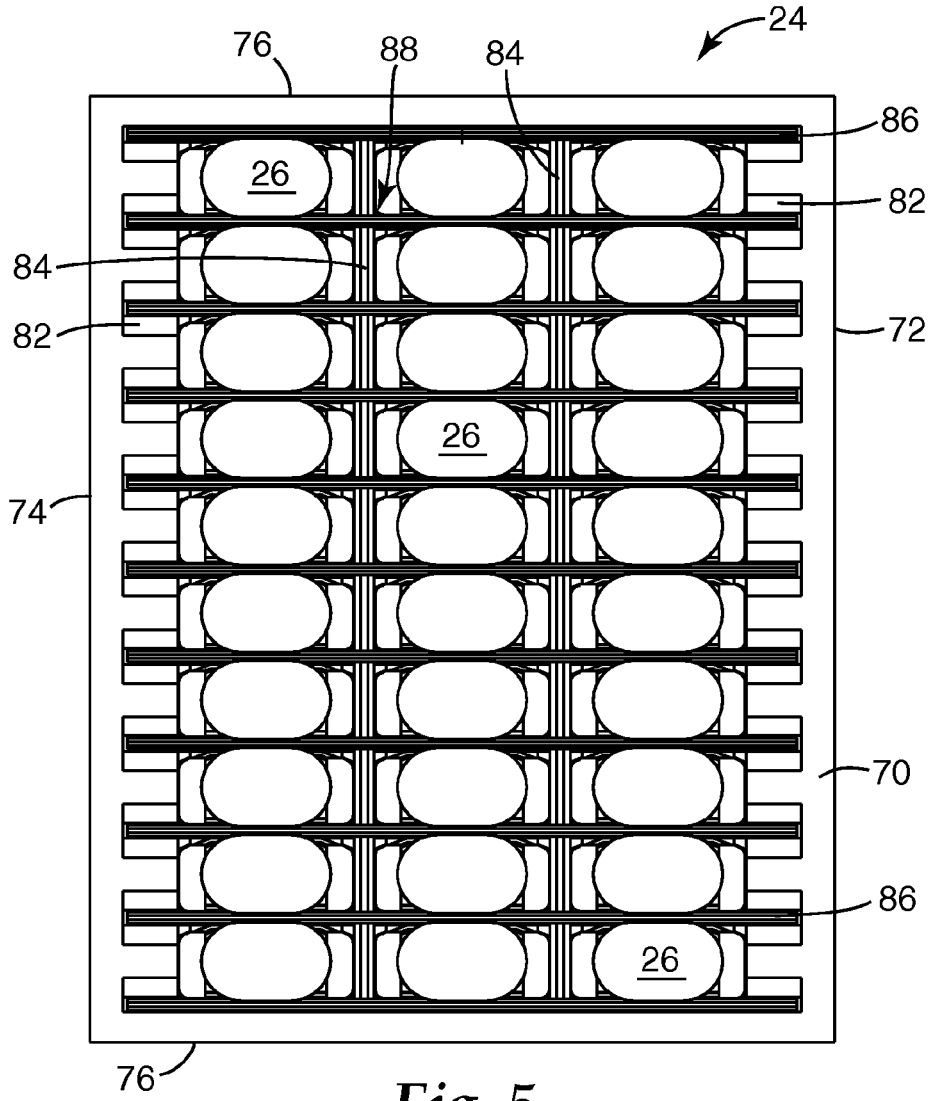
FIG. 5 is a top view of the carrier assembly shown in FIG. 4.

FIG. 4 is a perspective view and FIG. 5 is a top view of carrier assembly 24 according to one embodiment. Carrier assembly 24 includes a body 70 having opposing side walls 72, 74 and opposing end walls 76 (the nearest one of which has been removed in FIG. 4 for viewing an interior portion of body 70). Body 70 is generally fabricated of an electrically non-conducting material, such as plastic. Body 70 is suitably formed by injection molding, extrusion, casting, machining, while other portions of the electrically conductive components of body 70 are fabricated by molding, casting, stamping, or machining. Material selection will depend upon factors including chemical exposure conditions, environmental exposure conditions including temperature and humidity conditions, flame-retardancy specifications, material strength, or rigidity, to name a few. Fences 80 are formed on an exterior surface of opposing side walls 72, 74. Fences 80 are configured to align with and slide into channels formed on an interior surface of header 22 (FIG. 1) to mate carrier assembly 24 with header 22.

In one embodiment, slots 82 are formed in opposing interior surfaces of body 70, where slots 82 are sized to receive row organizer plates 86. The column and row organizer plates 84, 86 interlock to form an organizer 88. Organizer 88 separates termination devices 26 into an ordered 3×10 array of termination devices 26 as best shown in FIG. 5. Other array sizes for organizer 88 are also acceptable. In one embodiment, each edge 89 of row organizer plates 84 engages with a retention feature 114 (FIG. 6) of each termination device 26 to secure termination devices 26 within organizer 88.

With reference to FIG. 5, the interlocked column and row organizer plates 84, 86 secure termination devices 26 in an aligned orientation for connection with header 22 (FIG. 1). When carrier assembly 24 is mated with header 22, an external grounding portion (not shown) of each termination device 26 contacts and commonly grounds each of the grounding plates 32 (FIG. 2) within header 22. With the conventional header, an inserted connector makes contact with only one side of a grounding plate. In contrast with the known header, it has been surprisingly discovered that a significant improvement in electrical performance is achieved when termination device 26 contacts and commonly grounds two spaced apart grounding plates 32, such that each of the adjacent and spaced apart grounding plates 32 within header 22 is ground/contacted by a termination device 26.

In one embodiment, column and row organizer plates 84, 86 are fabricated from electrically conductive material and are configured to abut or engage with grounding plates 32 (FIG. 2) when carrier assembly 24 is inserted into header 22 to electromagnetically shield system 20 from outside electrical interference. In another embodiment, metal column and row organizer plates 84, 86 couple with and commonly ground each of grounding plates 32 provided in header 22.

Figure 6:
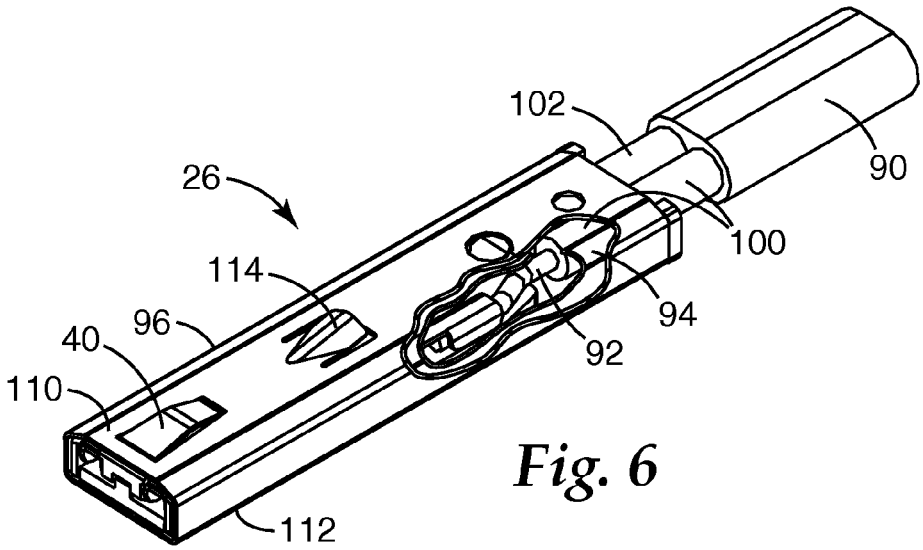
FIG. 6 is a perspective view of a termination device insertable into the carrier assembly shown in FIG. 4 according to one embodiment.

FIG. 6 is a perspective view of termination device 26. Termination device 26 includes a cable assembly 90 terminated to internal contacts 92, an insulator 94 disposed around contacts 92, and a tubular shield 96 disposed around insulator 94. In one embodiment, cable assembly 90 includes a first cable 100 and a second cable 102, where each of the cables 100, 102 are terminated to a separate one of the contacts 92.

The embodiment of cable assembly 90 illustrated provides a twinaxial cable assembly including first and second cables 100, 102. Other suitable cable assemblies 90 are also acceptable, including single wire cables (e.g., single coaxial cables and single twinaxial cables) or multi-wire cables (e.g., multiple coaxial cables, multiple twinaxial cables, or twisted pair cables). It is to be understood that different types and configurations of cable assemblies 90 may be suitably employed with termination device 26. For example, one of the termination devices 26 may include coaxial cables while another of the plurality of termination devices 26 may include twinaxial cables (or other cables).

Contacts 92 are accessible through a front edge of termination device 26 and are sized to electrically couple with end 62 of signal pins 30 (FIG. 3A). In one embodiment, contacts 92 include two internal contacts configured for use as signal contacts, ground contacts, or power contacts, as directed by the intended end-use application. When configured as a signal contact, internal contact 92 is electrically connected to a corresponding signal conductor of the associated cable 100, 102 and electrically insulated from shield 96. When configured as a ground contact, internal contact 92 is electrically connected to a corresponding grounding member of the associated cable 100, 102 and provides a return path ground for an associated signal. When configured as a power contact, internal contact 92 is electrically connected to a cable communicating with an electrical power source. The internal contacts 92 include at least one signal contact when termination device 26 is interconnected with header 22.

Insulator 94 separates internal contacts 92 from shield 96 and includes a suitable electrically insulating material such as plastic, although other insulating materials are also acceptable.

In one embodiment, shield 96 is a tubular metal ground shield having opposing major faces 110, 112, and retention feature 114 and external contact 40 (or ground beam 40) are formed on at least one of major surfaces 110, 112. Retention feature 114 projects from major face 110 to engage with edge 89 of row organizer plate 86 (FIG. 4). Retention feature 114 secures termination device 26 in carrier assembly 24 and resists pull out forces applied to cable assembly 90. In one embodiment, retention feature 114 is configured to release from row organizer plate 86 before cable assembly 90 pulls out from shield 96. In one embodiment, retention feature 114 includes a stamped prominence formed to extend from major surface 110 and is configured to release from row organizer plate 86 when an axial load of about 8 pounds is applied to cable assembly 90. Shield 96 is suitably formed to include other configurations of retention features. Suitable means for retaining termination device 26 in carrier assembly 24 include snap fit, friction fit, dress fit, mechanical clamping, or adhesive retention. In general, termination devices 26 are retained within carrier assembly 24 until removed. Removal of termination devices 26 from carrier assembly 24 enables replacing a damaged or defective termination device 26 or cable 100, 102 during maintenance and/or repair.

In one embodiment, ground beam 40 is a resilient, flexible member stamped into and extending from major surface 110 of ground shield 96. Ground beam 40 projects from ground shield 96 to compliantly press against one or more of grounding plates 32 provided within header 22 (FIG. 2) to form a common ground matrix around signal pins 30 for system 20. Other suitable alternate forms of ground beam 40 external contacts are also acceptable, including Hertzian bumps extending from tubular shield 96 or other suitable grounding contacts. In one embodiment, shield 96 is fabricated to include one external contact 40 on major surface 110. In other embodiments, each major surface 110, 112 is fabricated to include a separate external ground contact 40.

Figure 7:
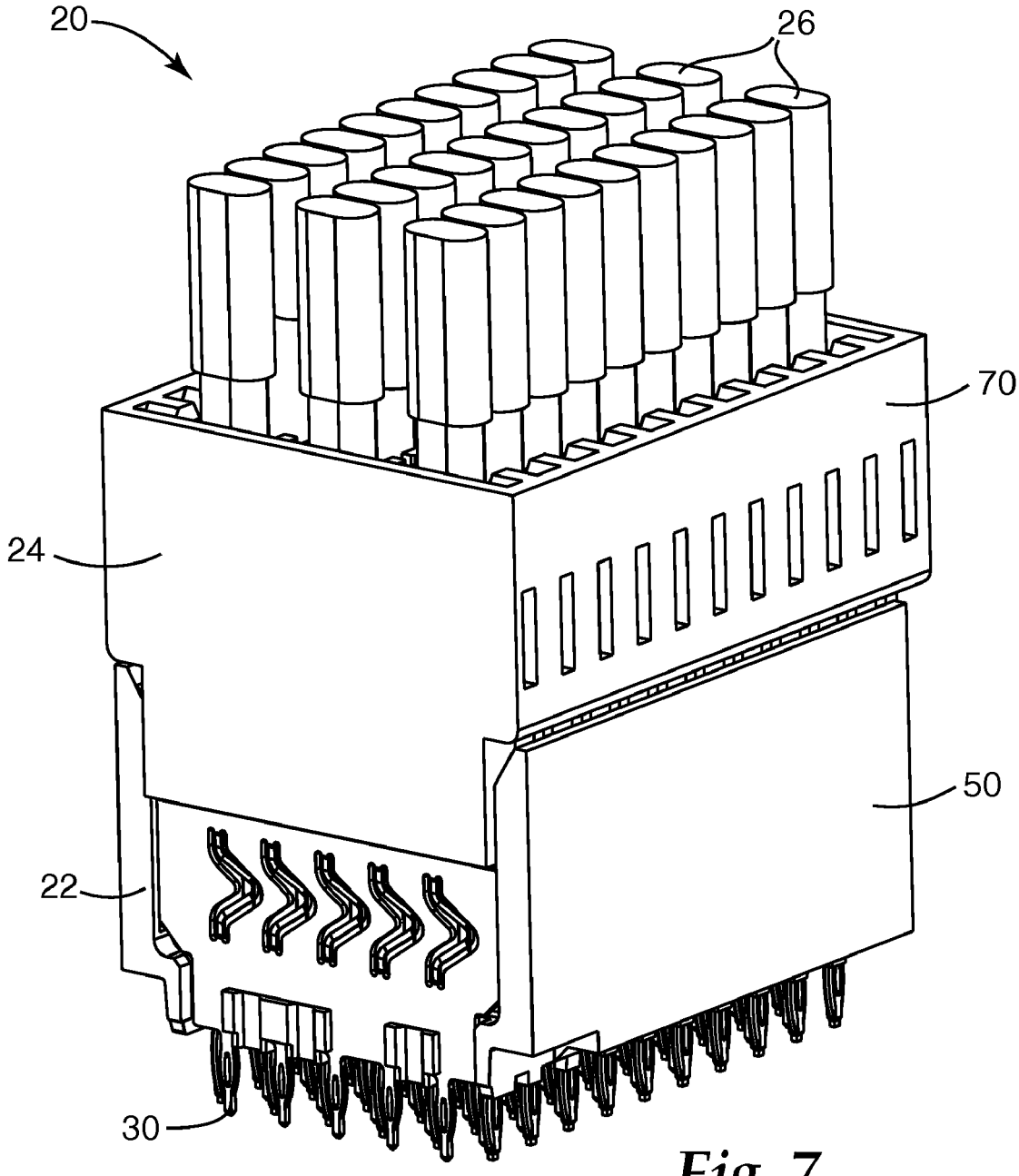
FIG. 7 is a perspective view of the carrier assembly shown in FIG. 1 mated with the header shown in FIG. 1.

FIG. 7 is a perspective view of electrical connector system 20 including carrier assembly 24 inserted into header 22. In one embodiment, header 22 is a 6×10 vertical very high density metric (VHDM) header and carrier assembly 24 provides a 3×10 array of 2.25×2 mm twinaxial shielded controlled impedance (SCI) termination devices 26. System 20 provides fully shielded twinaxial signals and common grounding for all grounding plates 32 (FIG. 1) within header 22 in a manner that minimizes cross-talk between connections and improves signal integrity within the header 22. With additional reference to FIGS. 5 and 6, when carrier assembly 24 is mated with header 22, the column and row organizer plates 84, 86 of organizer 88 and ground beam 40 of shields 96 combine to contact and commonly ground all stripline ground plates 32 of header 22.

Suitable termination devices consistent with this disclosure include 1×2 termination devices having two internal contacts 92, combinations of more than one 1×2 termination devices provided in a single unit, while retaining the functions described herein with respect to coaxial or twinaxial termination devices. For example, two 1×2 termination devices may be combined to form one 1×4 termination device, or one 2×2 termination device. Another example of an acceptable termination device includes a coaxial cable assembly having a 1×2 termination device with one pin dedicated to ground and another pin dedicated to signal. Coaxial 1×1 termination devices are also acceptable.

Figure 8:
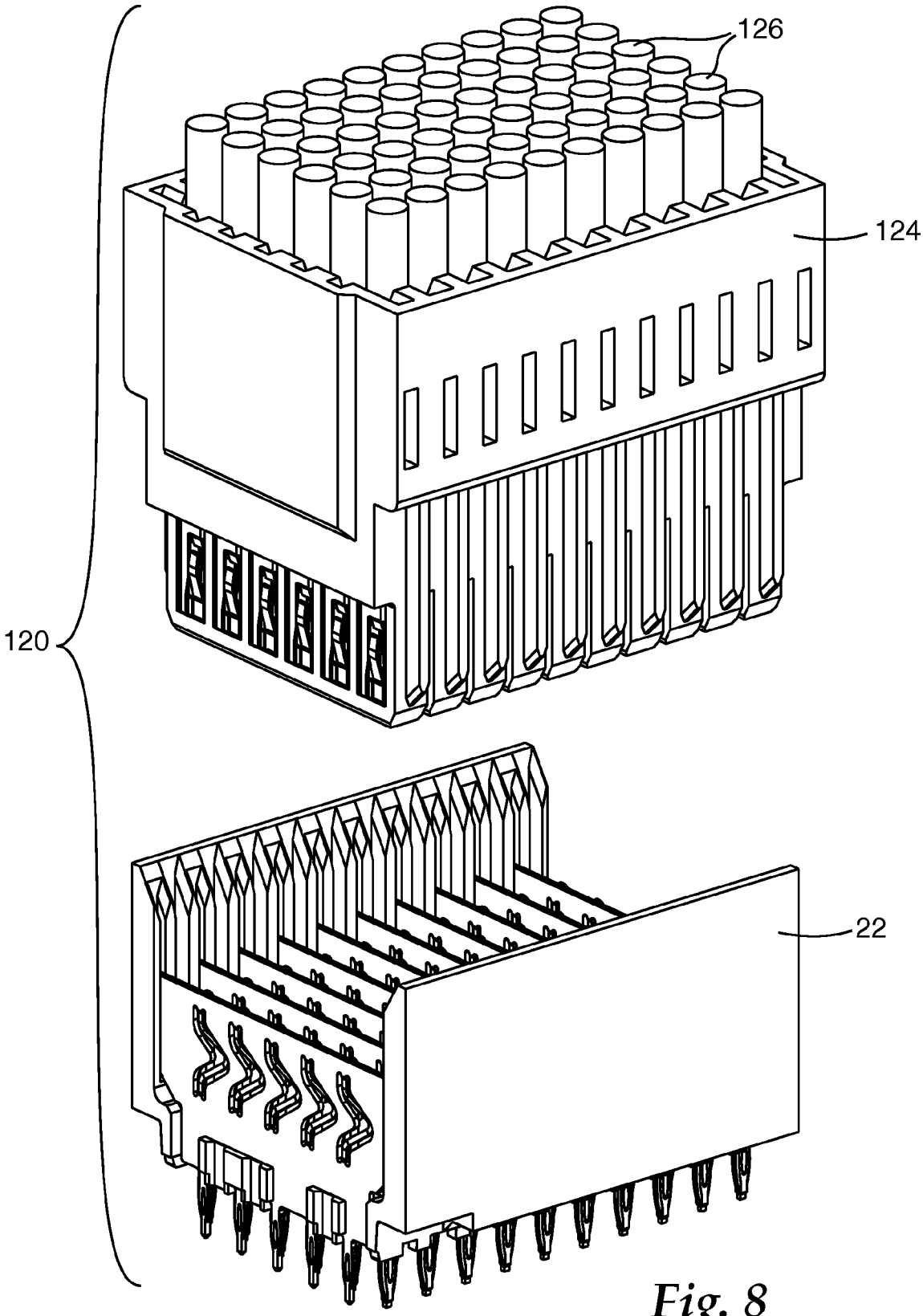
FIG. 8 is an exploded perspective view of an electrical connector system including another carrier assembly configured to couple with a header according to one embodiment.

FIG. 8 is a perspective view of an electrical connector system 120 according to another embodiment. System 120 includes header 22 described above and a carrier assembly 124 including a plurality of termination devices 126 that are configured to mate with header 22. Header 22 includes the signal pins 30 and grounding plates 32. Carrier assembly 124 includes a 6×10 array of termination devices 126. In one embodiment, termination devices 126 are 1 mm coaxial shielded controlled impedance (SCI) termination devices similar to the termination devices described in U.S. application Ser. No. 11/627,258 filed Jan. 25, 2007, which is incorporated herein in its entirety. In another embodiment, termination devices 126 are 1 mm coaxial SCI termination devices configured for connection to single-ended signal pins 30.

In one embodiment, termination devices 126 provide coaxial termination devices organized within carrier assembly 124 and are configured to mate with header 22 to convert header 22 to coaxial signals from the differential signals ordinarily provided by header 22.

Figure 9:
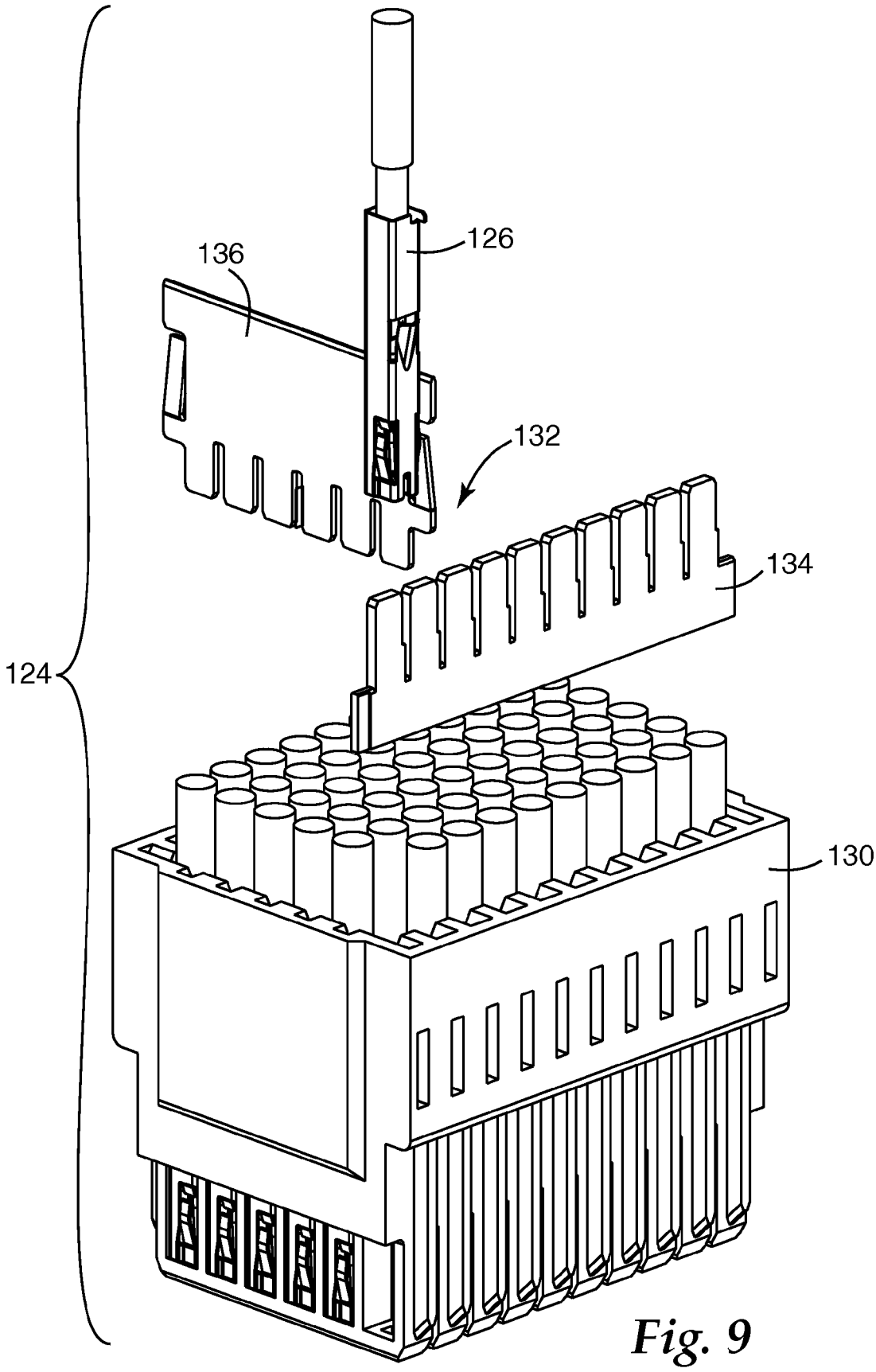
FIG. 9 is an exploded perspective view of the carrier assembly shown in FIG. 8.

FIG. 9 is an exploded perspective view of carrier assembly 124. Carrier assembly 124 includes a body 130 retaining an organizer 132 formed by interlocking column organizer plates 134 and row organizer plates 136. In one embodiment, organizer 132 includes seven column organizer plates 134 and eleven row organizer plates 136 that interlock to orient termination devices 126 into a 6×10 array of 1×1 2 mm SCI termination devices, although other numbers of organizer plates are also acceptable. In one embodiment, the 1×1 SCI termination devices 126 are mounted within carrier assembly 124 on 2.25×2 mm centers and are configured for electrical connection with VHDM header 22.

Termination devices 126 include a tubular shield having opposing ground wipers that are configured to commonly ground with grounding plates 32 of header 22 (FIG. 1). When system 120 shown in FIG. 8 is electrically connected, each termination device 126 connects with a signal pin 30 to form a coaxial signal path, and external ground wipers on termination device 126 extend between ground plates 32 to commonly ground each ground plate 32 within header 22 and provide a common ground matrix around signal pins 30.

Figure 10:
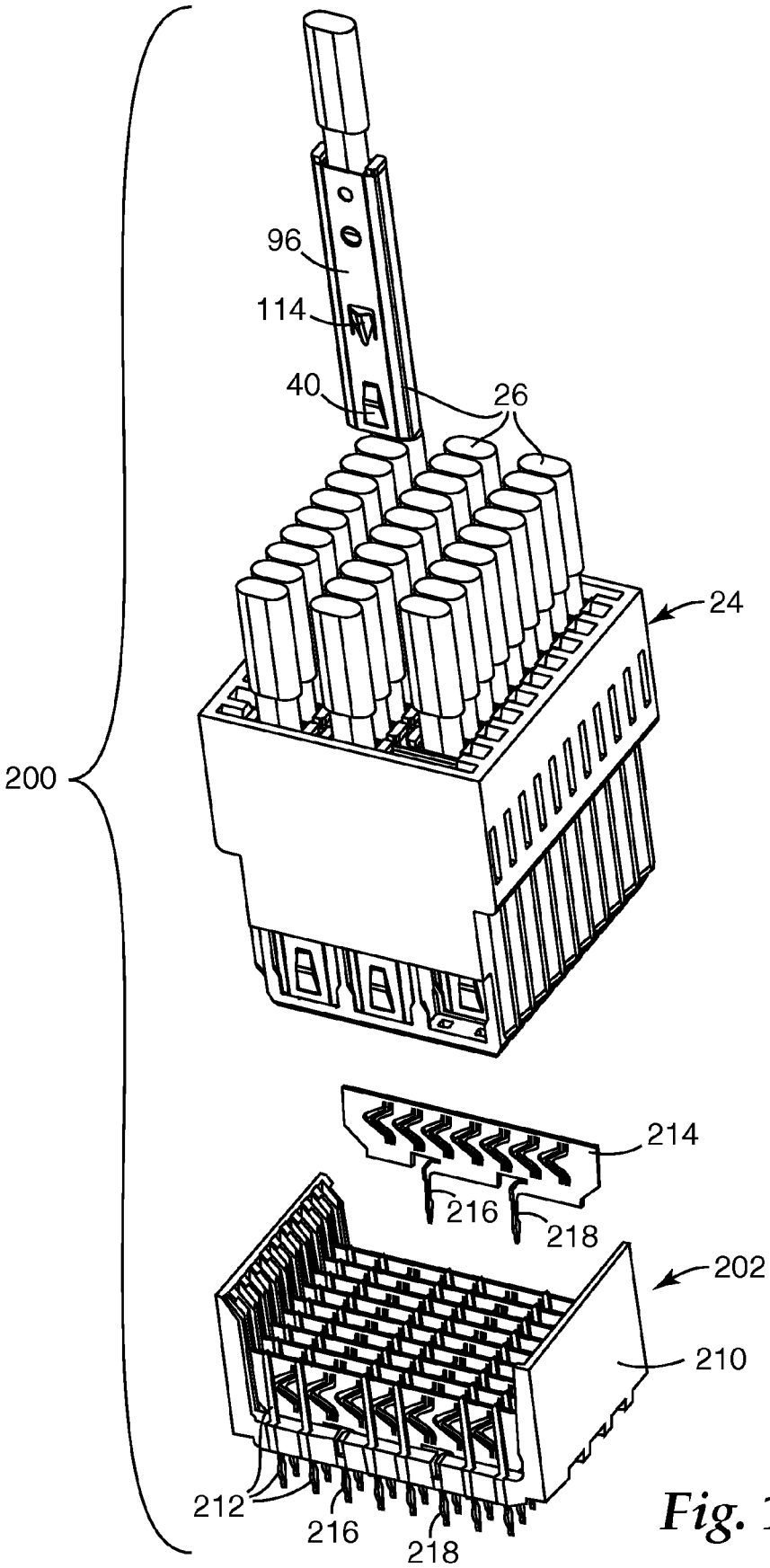
FIG. 10 is an exploded perspective view of an electrical connector system including a carrier assembly configured to couple with another header according to one embodiment.

FIG. 10 is an exploded perspective view of an electrical connector system 200 according another embodiment. System 200 includes carrier assembly 24 organizing termination devices 26 into an array suitable for insertion into a header 202. Carrier assembly 24 and termination devices 26 are substantially as described above and are configured to mate with the six-pins-per-column header 202. In particular, termination devices 26 include ground beam 40 projecting from shield 96, where ground beam 40 is configured to couple with header 202 to provide a common ground matrix around signal pins of header 202.

In one embodiment, header 202 includes a body 210 supporting a plurality of signal pins 212 and ground plates 214. In one embodiment, header 202 is a "high performance" 5 Gbs header having pairs of signal pins 212 separated by a distance P, signal traces separated by a distance D, and ground plates 214 provided with contact tails 216, 218. Header 202 provides columns of six signal pins 212 separated by grounding plates 214. Consequently, each column in header 202 includes eight contacts: six corresponding to signal pins 212 and two contacts provided by contact tails 216, 218. The spacing distance D is dictated by the space between signal pairs 212 in adjacent columns and represents a wide routing channel for signal traces. Header 202 is considered a "high performance" header in that the signal traces for header 202 are configured to be wider, having a lower loss, and the signal traces are straighter, which results in fewer impedance discontinuities and fewer signal reflections.

System 200 includes carrier assembly 24 that mates with the high performance header 202 to provide a common ground matrix around signal pins 212. The contact tails 216, 218 contribute to further grounding of grounding plate 214. To this end, system 200 includes fully shielded pairs of signal pins 212 having a common grounding matrix around each signal pin 212.

Figure 11:
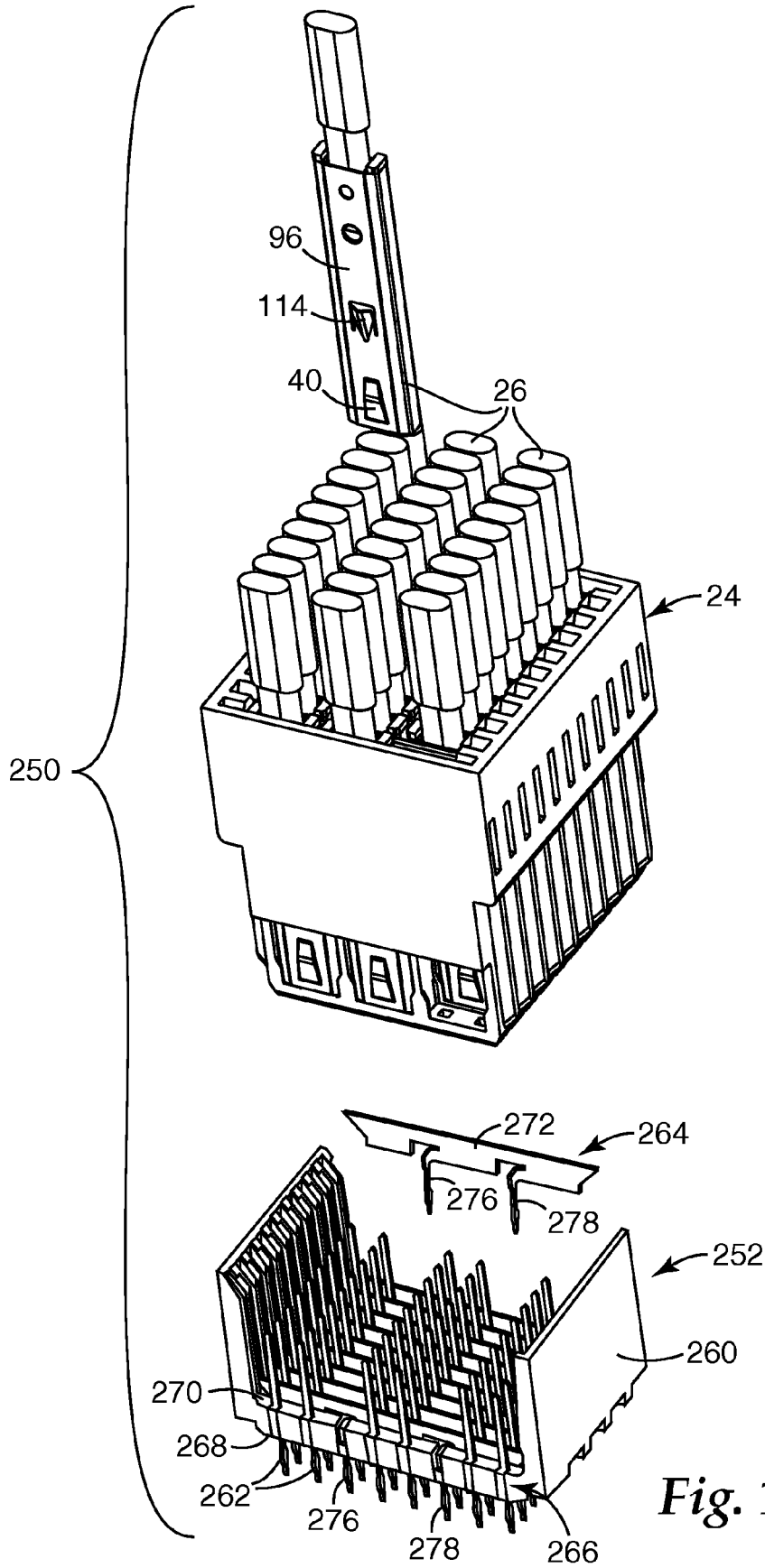
FIG. 11 is an exploded perspective view of an electrical connector system according another embodiment.

FIG. 11 is an exploded perspective view of an electrical connector system 250 according another embodiment. System 250 includes carrier assembly 24 organizing termination devices 26 into an array suitable for insertion into a header 252. Carrier assembly 24 and termination devices 26 are substantially as described above and are configured in this embodiment to mate with the 6×10 array of pins 262 provided by header 252.

In one embodiment, header 252 includes a body 260 supporting a plurality of signal pins 262 and short-shielded ground plates 264. Body 260 includes a wall 266 that defines a leading end 268 of header 252 opposite interior surface 270 of wall 266. Short-shielded ground plates 264 include an end 272 and contact tails 276, 278 extending away from end 272. When short-shielded ground plates 264 are inserted into wall 266, ends 272 are co-planar with interior surface 270 of wall 266 and contact tails 276, 278 project from leading end 268.

When carrier assembly 24 is mated to header 252, termination devices 26 engage with pins 262 and tubular shields 96 abut against ends 272 of short-shielded ground plates 264. It has been surprisingly discovered that tubular shields 96 of termination devices 26 need not even touch the ground plates 264 in header 252 to provide very good and improved electrical performance in comparison to conventional header assemblies. That is to say, when carrier assembly 24 is mated to header 252, improved electrical performance is derived by merely bringing tubular shields 96 into the vicinity of ends 272 of short-shielded ground plates 264. For example, the tubular shields 96 of the termination devices 26 can be spaced from the ends 272 of the short-shielded stripline ground plates 264 and still electrically shield the electrical connector system. To this end, carrier assembly 24 is configured to improve electrical performance of both VHDM header 22 (FIG. 1) and header 252 having short-shielded ground plates 264.

Embodiments provide a high speed carrier assembly that couples with a header to commonly ground all ground plates within the header. The carrier assembly includes multiple termination devices configured to electrically couple with a signal pin provided by the header. Each termination device includes a tubular shield that is configured to contact at least one of the ground plates within the header, such that the termination devices inserted into the header commonly ground all of the grounding plates in the header.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of carrier assemblies that connect with headers as discussed herein. Therefore, it is intended that this invention be limited only by the claims and the equivalents thereof.

What is claimed is:

1. An electrical connector system comprising:

a header comprising a leading end having a plurality of differential signal pins that are insertable into an electronic device and at least two separated stripline ground plates extending from the leading end toward a mating end of the header; and a carrier assembly coupleable with the mating end of the header, the carrier assembly comprising:

an organizer comprising a plurality of column organizer plates and row organizer plates that interlock to define an array of channels, a plurality of termination devices, each termination device at least partially disposed within one of the channels and including a contact configured to that electrically couple with one of the differential signal pins, an insulator disposed around the contact, and a tubular shield disposed around the insulator;

wherein the organizer abuts the stripline ground plate to electronically shield connections within the electrical connector system, and wherein the header comprises a wall defining the leading end and the stripline ground plates comprise short-shielded stripline ground plates having ends that are co-planar with an interior surface of the wall, the organizer and the tubular shields of the termination devices spaced from the ends of the short-shielded stripline ground plates to electrically shield the electrical connector system.

2. The electrical connector system of claim 1, wherein the header comprises at least two rows of adjacent signal pins and one stripline ground plate between each row of adjacent signal pins, the tubular shield configured to fully shield each signal pin and to commonly ground adjacent stripline ground plates.

3. The electrical connector system of claim 1, wherein each tubular shield is configured to commonly ground the at least two separated stripline ground plates.

4. The electrical connector system of claim 3, wherein the tubular shield comprises at least one external ground contact that is configured to compliantly contact the stripline ground plate.

5. The electrical connector system of claim 3, wherein each termination device comprises a coaxial termination device comprising a coaxial cable having a coaxial conductor terminated to the contact, the contact configured to electrically couple with one of the differential signal pins to provide a coaxial signal pin.

6. The electrical connector system of claim 3, wherein each termination device comprises a twinaxial termination device including two contacts configured to electrically couple with a pair of differential signal pins provided by the header, the insulator disposed around the two contacts, and the tubular shield configured to fully shield each pair of differential signal pins and including an external ground beam configured to contact the stripline ground plate.

7. The electrical connector system of claim 1, wherein the header comprises rows of differential signal pins and at least a first stripline ground plate separated from a second stripline ground plate, the contact of each termination device configured to electrically couple with a differential signal pin and the tubular shield of each termination device configured to fully shield the differential signal pin and commonly ground the first and second stripline ground plates.

8. The electrical connector system of claim 7, wherein each termination device comprises a coaxial termination device configured to electrically couple with one of the differential signal pins to provide a coaxial signal pin.

9. The electrical connector system of claim 7, wherein each termination device comprises a twinaxial termination device including two contacts configured to electrically couple with one pair of differential signal pins to provide the header with paired twinaxial signal pins, the insulator disposed around the two contacts.

10. The electrical connector system of claim 1, wherein the tubular shield comprises at least one external ground contact that is configured to compliantly contact the stripline ground plate.

11. The electrical connector system of claim 10, wherein the tubular shield comprises an exterior tubular surface and first and second opposing external ground contacts projecting away from opposing sides of the exterior tubular surface.

* * * * *